US008270616B2

(12) United States Patent
Slamka et al.

(10) Patent No.: US 8,270,616 B2
(45) Date of Patent: Sep. 18, 2012

(54) VIRTUAL SURROUND FOR HEADPHONES AND EARBUDS HEADPHONE EXTERNALIZATION SYSTEM

(75) Inventors: Milan Slamka, Camas, WA (US); Ivo Mateljan, Split (HR); Michael Howes, Vancouver, WA (US)

(73) Assignee: Logitech Europe S.A., Morges (CH)

( * ) Notice: Subject to any disclaimer, the term of this patent is extended or adjusted under 35 U.S.C. 154(b) by 1104 days.

(21) Appl. No.: 12/024,970

(22) Filed: Feb. 1, 2008

(65) Prior Publication Data

US 2012/0201405 A1 Aug. 9, 2012

Related U.S. Application Data

(60) Provisional application No. 60/899,142, filed on Feb. 2, 2007.

(51) Int. Cl.
*H04R 5/00* (2006.01)
*H04R 5/02* (2006.01)

(52) U.S. Cl. ..... 381/17; 381/309; 381/1

(58) Field of Classification Search ..... 381/1, 309–310, 381/300, 303, 306, 61, 63, 17, 18, 74
See application file for complete search history.

(56) References Cited

U.S. PATENT DOCUMENTS

| | | | | |
|---|---|---|---|---|
| 5,742,689 | A * | 4/1998 | Tucker et al. | 381/17 |
| 6,181,800 | B1 * | 1/2001 | Lambrecht | 381/310 |
| 6,421,446 | B1 * | 7/2002 | Cashion et al. | 381/17 |
| 7,167,567 | B1 * | 1/2007 | Sibbald et al. | 381/17 |
| 7,266,207 | B2 * | 9/2007 | Wilcock et al. | 381/310 |
| 2003/0095668 | A1 * | 5/2003 | Wilcock et al. | 381/56 |
| 2003/0215097 | A1 * | 11/2003 | Crutchfield, Jr. | 381/61 |
| 2005/0265558 | A1 * | 12/2005 | Neoran | 381/17 |
| 2005/0276430 | A1 * | 12/2005 | He et al. | 381/309 |
| 2006/0147068 | A1 * | 7/2006 | Aarts et al. | 381/309 |

* cited by examiner

*Primary Examiner* — Elvin G Enad
*Assistant Examiner* — Alexander Talpalatskiy
(74) *Attorney, Agent, or Firm* — Kilpatrick Townsend & Stockton LLP

(57) ABSTRACT

A combination of techniques for modifying sound provided to headphones to simulate a surround-sound speaker environment with listener adjustments. In one embodiment, Head Related Transfer Functions (HRTFs) are grouped into multiple groups, with four types of HRTF filters or other perceptual models being used and selectable by a user. Alternately, a custom filter or perceptual model can be generated from measurements of the user's body, such as optical or acoustic measurements of the user's head, shoulders and pinna. Also, the user can select a speaker type, as well as other adjustments, such as head size and amount of wall reflections.

16 Claims, 11 Drawing Sheets

Vertical-Polar
Coordinates

VIRTUAL SURROUND FOR HEADPHONES AND EARBUDS HEADPHONE EXTERNALIZATION SYSTEM

CROSS-REFERENCES TO RELATED APPLICATIONS

This patent application is a non-provisional of and claims the benefit of the filing date of U.S. Provisional Patent Application No. 60/899,142 filed on Feb. 2, 2007 entitled "Virtual Surround for Headphones and Earbuds—Headphone Externalization System", which is herein incorporated bye reference in its entirety for all purposes.

BACKGROUND OF THE INVENTION

The present invention is directed to a headphone externalization processing system, in particular a combination of hardware and software for digital signal processing of sound signals that are recorded in mono, stereo or surround multichannel techniques. The headphone externalization processing software gives headphone listeners the same feeling of sound as it can be obtained by listening to high quality loudspeaker system in a control room with good acoustics.

DEFINITIONS

HRIR—Head Related Impulse Response is acoustical response function from the source position in the free field to the entrance of the ear canal. It is result of diffraction on human shoulders, head and pinna (the part of the ear outside the head).

HRTF—Head Related Transfer Function is a transfer function from the source position in the free field to the entrance of the ear canal. It is result of diffraction on human shoulders, head and pinna. Usually it is estimated from HRIR using Fourier transform.

HRTF filter—filter that has frequency response equal to frequency characteristic of HRTF.

Listening to the headphones usually gives the impression that the sound is localized "in the head", near the ear (or near the headphones). This impression of sound is flat and lacks the sensation of dimensions. This phenomenon is often referred in literature as lateralization, meaning 'in-the-head' localization. Long-term listening to lateralized sound will lead to a listening fatigue.

To overcome above stated problems, it is necessary to apply some kind of processing system to get the proper feeling of sound source position—localization and feeling of acoustical space—called spatialization. Such a processing system is called Headphone externalization processing system.

There are several processing systems that try to solve the externalization problem. They generally use the following processing models:

1. HRTF based filtering with proper interaural time and intensity difference (the difference in when sounds arrive at the two ears, and the different intensities when the sounds arrive).
2. Room Sound Reflection and Reverberation Models.
3. Head-Movement Models.

For example, listeners are used to the effects of sound waves bouncing off their shoulders, head, and ear. An earphone obviously doesn't naturally have this affect. Acoustic differences are imposed by the mechanical filters such as pinna, head and shoulders on incoming sound waves related by frequency, azimuth and elevation. In cases where earbuds or headphones are used, electronic filters need to duplicate the functions of these mechanical filters to some degree of accuracy. This leads to a term of partially individualized HRTF from selection of closely spaced HRTF's.

Existing virtual systems include the Dolby headphone [as described in C. P. Brown, R. O. Duda, IEEE Trans. Speech and Audio Processing, Vol. 5. No. 5, September (1998) and E. J. Angel, et al.: On the design of canonical sound localization elements, AES 113th Convention Paper, Los Angeles, October (2002)] the AKG Hearo [as described in the same references], the Bayer Dynamics Headzone [as described in the same references and also in W. G. Gardner: 3-D Audio Using Loudspeakers, Ms thesis, MIT (1997)], the Studer BRS [as described in the same references] and the Creative Labs Soundblaster CMSS [as described in the same references]. They all use HRTF from different databases, some more accurate than others. All use some form of reflection and reverberations, not necessarily reflecting on real listening environment and situations. A lot of artificial equalization and signal shaping is used to improve the headphone sound, but still there are some areas for improvement. The front-back localization of sound sources is ambiguous. The listening experience is artificial with a lack of acoustic experience that is common in listening to loudspeakers in real rooms. This results in fatigue in prolonged listening tests. In all except in the AKG Hearo system, there is no ability for the user to "individualize" the HRTF processing system to characteristics of the user's own ear. The existing systems generally require a large amount of processing power.

TABLE 1

| Reverberation time in Dolby Headphone simulation of small and large room | | | | | | | | |
|---|---|---|---|---|---|---|---|---|
| | WideBand | 125 Hz | 250 Hz | 500 Hz | 1000 Hz | 2000 Hz | 4000 Hz | 8000 Hz |
| Reverberation time of Dolby headphone small room | | | | | | | | |
| T60 (s) | 0.213 | 0.180 | 0.279 | 0.250 | 0.236 | 0.240 | 0.210 | 0.168 |
| Reverberation time of Dolby headphone large room | | | | | | | | |
| T60 (s) | 0.204 | 0.181 | 0.197 | 0.226 | 0.228 | 0.233 | 0.203 | 0.168 |

Table 1 shows reverberation time in Dolby simulation of small and large rooms. The fact that small and large rooms have the same reverberation time indicates an artificial aspect of signal processing. The only difference shown is in delay of early reflections.

Other examples of prior art include U.S. Pat. No. 6,771,778 which discusses interaural time differences and U.S. Pat. No. 6,421,446 which discusses reflection and reverberation.

Examples of user adjustable headphones are U.S. Pat. No. 7,158,642 which describes a user adjustment of sound pressure, and U.S. Pat. No. 5,729,605 which describes a mechanical adjustment to change the sound.

BRIEF SUMMARY OF THE INVENTION

The present invention provides a combination of techniques for modifying sound provided to headphones to simulate a surround-sound speaker environment. User adjustments are also provided.

In one embodiment, Head Related Transfer Functions (HRTFs) or other perceptual models can be matched to a particular user. For example, HRTFs can be grouped into four (or any other number) groups, with four corresponding types of HRTF filters being used and selectable by a user. The user can select based on which sounds best, or a selection can be based on measurements of the user's body, in particular the user's particular head, shoulder and pinna shapes and geometry. The user can measure these, or optical, acoustical or other measures could be used to do the measurement, and from the measurement automatically determine the correct model.

In another embodiment, a Head Related Transfer Functions (HRTFs) or other perceptual models can be customized for a particular user based on measurements of that user's body, in particular the user's particular head, shoulder and pinna shapes and geometry. The user can measure these, or optical, acoustical or other measures could be used. Instead of using the measurements to select and existing model, a custom model could be generated.

The measurements could be made optically, such as with a web cam. Or the measurements can be made acoustically, such as by putting microphones in the users ear and recording how sound appears at the ear from a known sound source. The measurements could be done in the user's home, so the headphones would simulate that user's surround sound speaker environment, or could be done in an optimized studio.

In one embodiment, the user can make a number of adjustments. The user can select from among 4 groups of HRFT filters based on measured data. Alternately, the user can select other models. The user can select, head size and loudspeaker type (e.g., omnidirectional, unidirectional, bidirectional). The user can also select the amount of wall reflections and reverberation, such as by using a slider or other input. The invention can be applied to stereo or multichannel sound of any number of channels.

In one embodiment, the Interaural Intensity Difference (IID) and Interaural Time Difference (ITD) are modified when the virtual sound source (simulated speaker location) is very close to the head. In particular, when the source is closer than five times the head radius, the intensity difference is increased at low frequencies.

DETAILED DESCRIPTION OF THE INVENTION

Overall System

Figure 1:
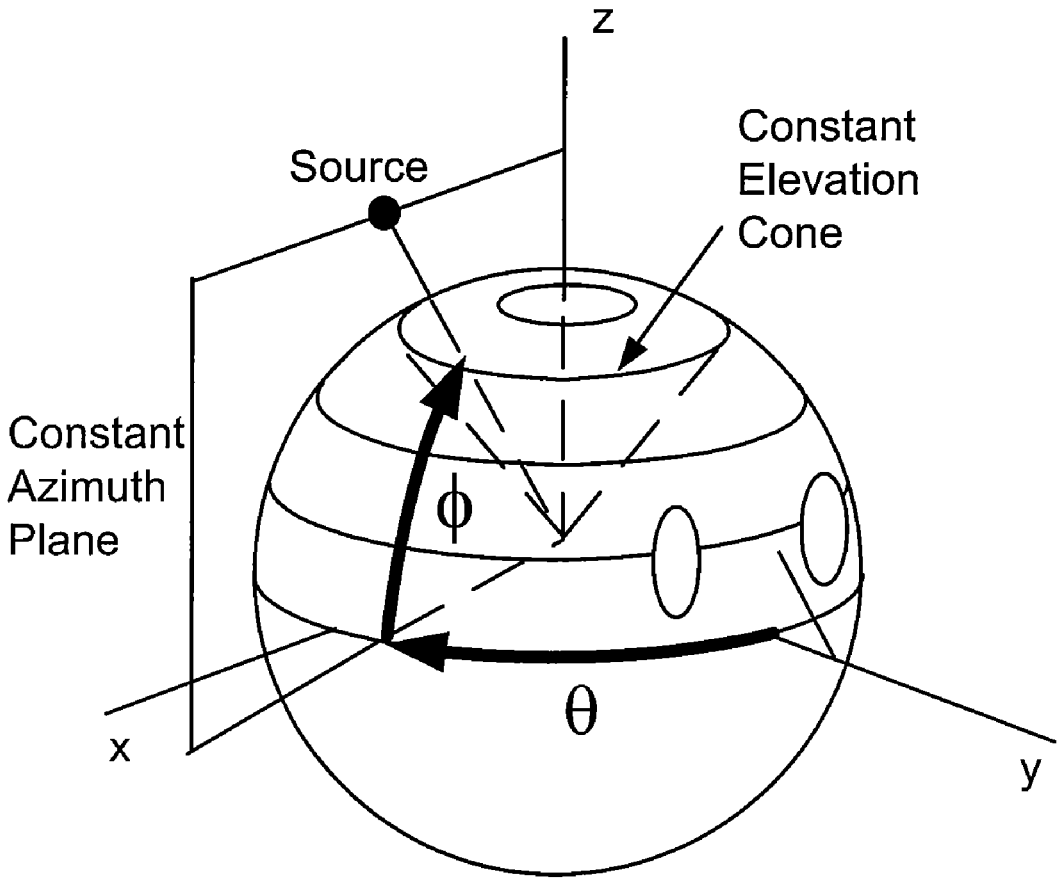
FIG. 1 is a diagram of a prior art Vertical—Polar coordinate system.

Embodiments of the present invention provide a method and signal processing framework for headphone binaural synthesis that use partially individualized HRTFs to improve headphone listening perception of stereo/multi-channel (e.g. 5.1 or 7.1) audio sound that are intended for loudspeaker playback.

Since HRTFs are highly individual-variant, it is not suitable to use overly simplified generic models, or apply only one set of HRTF filters and convert them to HRTFs of different locations. On the other hand, it is also too expensive and not necessary to conduct HRTF measurements for each individual user. The present invention provides a solution by providing some freedom of user-selection from the existing and classified set of HRTFs according to their own preferences. This application scenario is practical, especially for PC headphones, where some user selection software interfaces allow a user to choose the candidate HRTF sets, or to download more candidate HRTF sets from the internet. After the selection of user preferred HRTFs, they are used by the audio processing drivers to achieve binaural synthesis audio effects specifically customized to the PC owner's needs.

Although it is impossible to find exactly the same HRTF for each individual, due to the infinite variations in head size, shoulder and torso geometries, and pinna differences, it is more practical for each individual to find a closely matched HRTF from a limited set of classes of HRTFs. For example, the classification can be based on existing measured HRTF databases. To make the HRTF candidates more generic and less overly individualized, frequency domain smoothing in critical bands can be performed to HRTFs and HRTF processing can be performed with its time domain counterpart, HRIR, in the form of IIR filters extracted from such smoothed HRTFs.

In addition, the system can also incorporate early reflection and reverberation components.

The coloring effects of HRTFs are applied to the direct-sound and the early reflection components, not to the reverberation components, since they should be diffuse. The reverberation components can be computed by reverberation models that have the freedom of adjusting reverberation time (T60) according to room volume and achieve different room effects. By using specific reverberation models, e.g., Schroeder reverberator, the coefficients of reverberation filters can be determined by such room-dependent reverberation time T60.

The early reflection components are computed using room geometries and loudspeaker-listener setups and by considering loudspeaker radiation patterns, instead of by a limited set of simple FIR reflection filters and selected using look-up table according to current positions, as in some prior art. Image method and loudspeaker polar pattern assumptions can be used to obtain early reflection signals in real time.

The delays from the loudspeakers to the left and right ears are also computed from the listening configuration, in which the head size can be adjusted by the user for the selection to his/her preference. Alternatively, the size of the user's head can be obtained from physical measurements or optical analysis.

The head shadowing effects are not intuitively represented as attenuation factors stored in a table as in some prior art, but are directly embodied in the user selected HRTF.

For a PC application, as opposed to a gaming application, there will usually be no requirements to adjust the elevation of loudspeakers. Thus constant, but user selected, HRTFs will be sufficient to capture the pinna, shoulder and torso effects.

Partially Individualized HRTF Filter

A partially individualized HRTF filter is a filter that a listener can choose from a set of HRTFs. We have analyzed large databases of measured HRIR on actual listeners's heads from CIPIC laboratory [CIPIC database of HRIR—http://interface.cipic.ucdavis.edu/] and IRCAM Room acoustics group [IRCAM database of HRIR—from LISTEN project, http://rechercheircam.fr/equipes/salles/listen/index.html, Room Acoustics Team, IRCAM] (project LISTEN). A preferred embodiment of the present invention uses the IRCAM database since those measurements are close to measurements by the present inventors.

By close inspection of the IRCAM HRTF database, we recognized that all HRTFs can be grouped into four groups with similar HRTF, so we implemented in the preferred embodiment an externalization program using four types of HRTF filters. Alternately, 3, 5, 6, 7, 8 or any other number of groupings could be used.

| IRCAM database group | HRTF1 | HRTF2 | HRTF3 | HRTF4 |
|---|---|---|---|---|
| Listeners with similar HRTF | 10 | 13 | 6 | 20 |

Further, to make the HRTFs more applicable to a variety of headphones all responses were equalized with a diffuse field correction, and smoothed in critical acoustical band (close to ⅓ octave band on frequencies above 500 Hz).

Such processed HRIR were used in a classical estimation of IIR filter using Yulewalk correlation based minimum phase estimation of filter coefficients in the following form:

$$H_{IIR}(z) = \frac{\sum_{i=0}^{m} b_i z^{-i}}{1 + \sum_{i=1}^{m} a_i z^{-i}}$$

The filtering operation, getting output y[n] from input x[n], in discrete time domain is then defined with the expression:

$$y[n]=b[0]*x[n]+b[1]*[n-1]+\ldots+b[m]*x[n-m-1]-a[1]*y[m-1]-\ldots-a[n+1]*y[n-m]$$

Humans have an ability to localize sound sources, we also have sense of acoustical space in which there are reflections and reverberation of sound energy. Spatialization and localization are not strongly correlated; in open space we can localize sound precisely but we lack some "spatial sound characteristic". In more reverberant environments we can have nice sense of "spatial sound", but with reduced sound source localization. When we analyze sound reproduction using headphones we are interested in "spatialization" that has good localization properties, and without lateralization effects.

The simplest form of spatialization for headphones can be based on interaural level and time differences. It is possible to use only one of the two cues (time and intensity differences), but using both cues will provide a stronger spatial impression. Interaural time and intensity differences are just capable of moving the apparent azimuth of a sound source, without any sense of elevation. Moreover, the apparent source position is likely to be located inside the head of the listener, without any sense of externalization. Special measures have to be taken in order to push the virtual sources out of the head.

A finer localization can be achieved by introducing frequency-dependent interaural differences, by means of equivalent HRTF processing. Due to diffraction, the low frequency components are barely affected by IID (Interaural Intensity Difference) and the ITD (Interaural Time Difference) is larger in the low frequency range. Mathematically it is expressed in Brown-Duda spherical head model as described below.

The Brown-Duda model [C. P. Brown, R. O. Duda, *IEEE Trans. Speech and Audio Processing, Vol.* 5. No. 5, September (1998)] of sound diffraction on a spherical head is shown below. In this discussion we shall use the polar coordinate system as shown in FIG. 1.

Figure 2A:
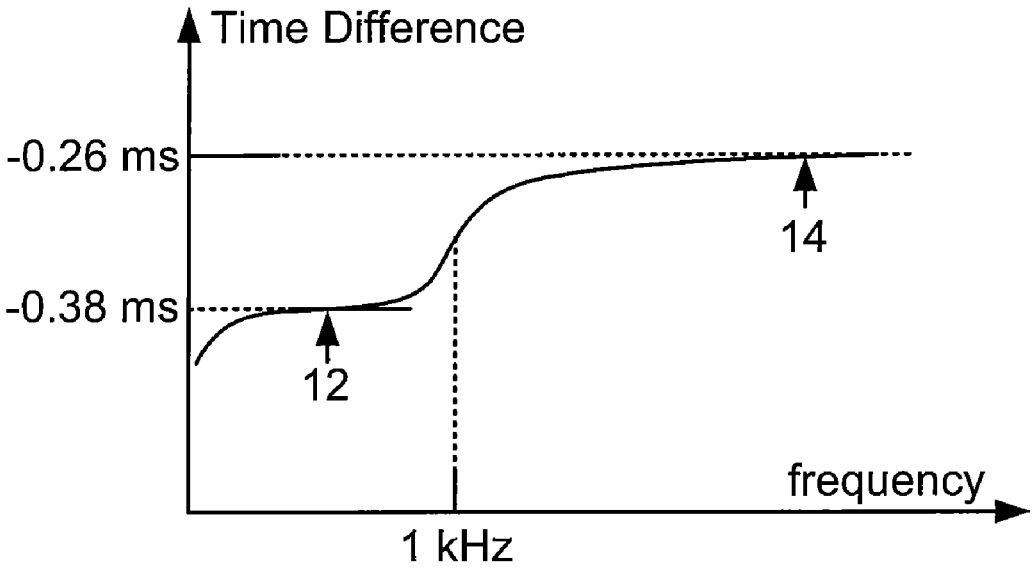
FIGS. 2*a* and 2*b* are graphs showing varying interaural time differences and intensity differences in accordance with an embodiment of the invention.
Figure 2B:
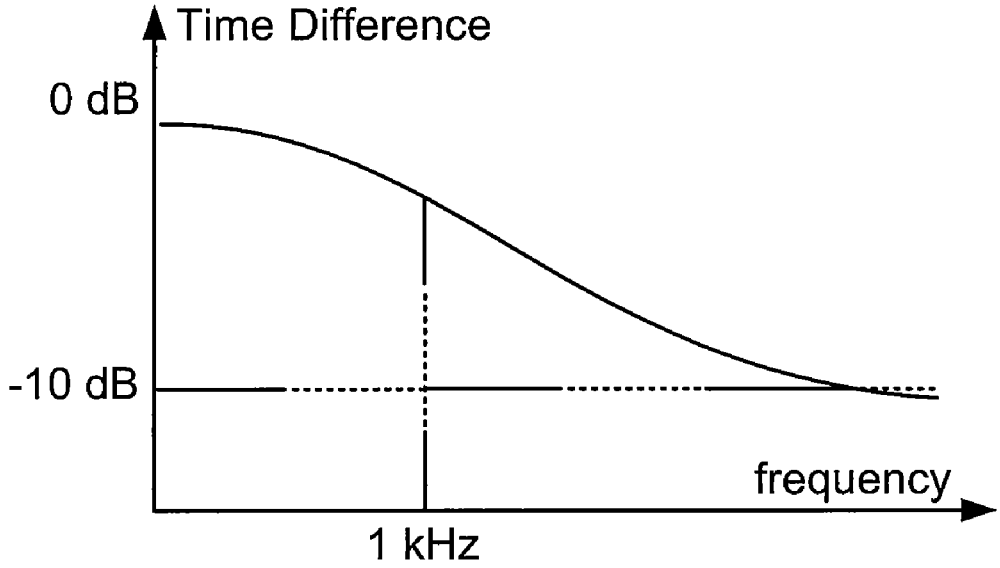

Calculations done with a spherical head model and a binaural model [C. P. Brown, R. O. Duda, *IEEE Trans. Speech and Audio Processing*, Vol. 5. No. 5, September (1998)] give us approximated frequency-dependent IID and ITD curves, one being displayed in FIGS. 2*a-b* for 30° of azimuth. The curve can be further approximated by constant segments 12 and 14, with segment 12 corresponding to a delay of about 0.38 ms at low frequencies, and segment 14 corresponding to a delay of about 0.26 ms at high frequencies.

Figure 3:
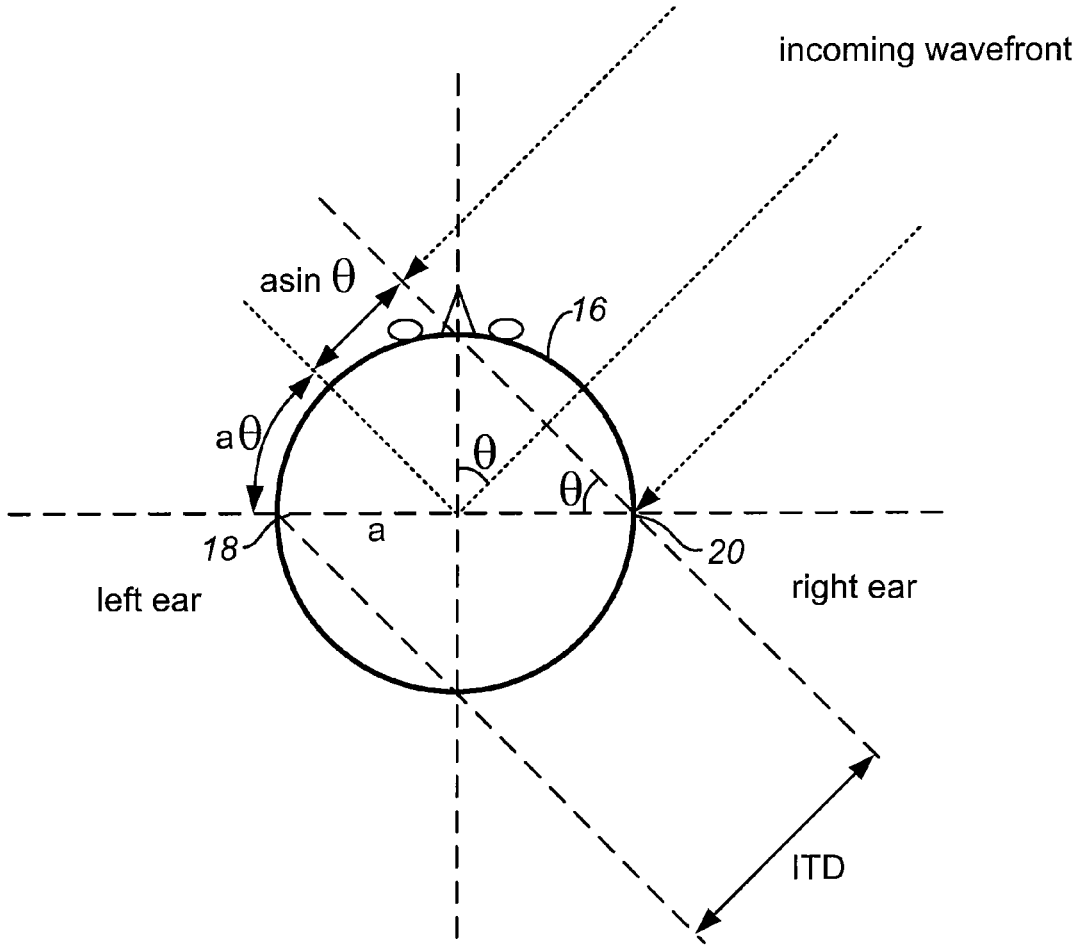
FIG. 3 is a diagram of a simplified spherical head model.

The low-frequency limit can in general be obtained for a general incident angle θ by the formula $$ITD_{lf} = \frac{1.5d\sin(\theta)}{c} \tag{1}$$

where d is the inter-ear distance in meters and c is the speed of sound. The crossover point between high and low frequency is located around 1 kHz. FIG. 3 illustrates this, showing a spherical head 16 with a left ear position 18 and a right ear position 20. As can be seen, for on incoming wavefront from the right side, there is an interaural time difference ITD between when the wavefront reaches the right ear 20 and when it reaches the left ear 18.

The high frequency limit is:

$$ITD_{hf} = \frac{a\theta + a\sin(\theta)}{c},\ a = d/2 \tag{2}$$

IID is also frequency dependent. The difference is larger for high-frequency components, i.e. FIG. 2(*b*) shows IID for 30° of azimuth.

The IID and ITD are additionally changing when the source is very close to the head. In particular, sources closer than five times the head radius increase the intensity difference at low frequency. The ITD also increases for very close sources but its changes do not provide significant information about source range.

The effect of head diffraction of human body, head and pinna can be measured as Head Related Impulse Response (HRIR) or Head Related Frequency Response (HRFR), and applied in DSP processing filters.

In one embodiment, a simple analytical model of the external hearing system is used. Such a model can implemented more efficiently, thus either reducing processing time or allowing more sources to be spatialized in real time.

Modeling the structural properties of the system, pinna-head-torso, gives us the option to apply a continuous variation to the positions of sound sources and to the morphology of the listener. Much of the physical/geometric properties can be understood by careful analysis of the HRIR's, plotted as surfaces, functions of the variables time and azimuth, or time and elevation.

This is the approach taken by Brown and Duda [C. P. Brown, R. O. Duda, *IEEE Trans. Speech and Audio Processing*, Vol. 5. No. 5, September (1998)] who came up with a model which can be structurally divided into three parts:

Head Shadow and ITD

Shoulder Echo

Pinna Reflections

Starting from the approximation of the head as a rigid sphere that diffracts a plane wave, the shadowing effect can be effectively approximated by a first order continuous-time system, i.e., a pole-zero couple in the Laplace complex plane:

$$H(s,\theta)=\frac{a(\theta)s+\beta}{s+\beta}=\frac{1+s\tau\alpha(\theta)}{1+s\tau}, \tag{3}$$

where the time constant τ is related to the effective radius a of the head and the speed of sound c by $$\tau=\frac{a}{2c} \tag{4}$$

The position of the zero varies with the azimuth θ according to the function $$\alpha(\theta)=1.05+0.95\cos\left(\frac{\theta-\theta_{ear}}{150^\circ}180^\circ\right) \tag{5}$$

where $\theta_{ear}$ is the angle of the ear that is being considered, typically 100° for the right ear and −100° for the left ear. The pole-zero couple can be directly translated into a stable IIR digital filter by bilinear transformation, and the resulting filter (with proper scaling) is $$H_{hs}(z,\theta)=\frac{(1+\alpha(\theta)\tau F_w)+(1-\alpha(\theta)\tau F_w)z^{-1}}{(1+\tau F_w)+(1-\tau F_w)z^{-1}} \tag{6}$$

where $F_W$ is warped frequency $F_W=(f_s/a\tan(1/(\tau f_s))$.

The ITD can be obtained in two ways. The first is to use the relationship for group delay (2) for the opposite ear or use the following formula for the delay to both ears (reference point is in the center of the head):

$$\tau_h(\theta)=\frac{a}{c}+\begin{cases}-\frac{a}{c}\cos(\theta-\theta_{ear}), & \text{if } 0\le|\theta-\theta_{ear}|<\frac{\pi}{2}\\ \frac{a}{c}\left(|\theta-\theta_{ear}|-\frac{\pi}{2}\right), & \text{if } \frac{\pi}{2}\le|\theta-\theta_{ear}|<\pi\end{cases} \tag{7}$$

Figure 4A:
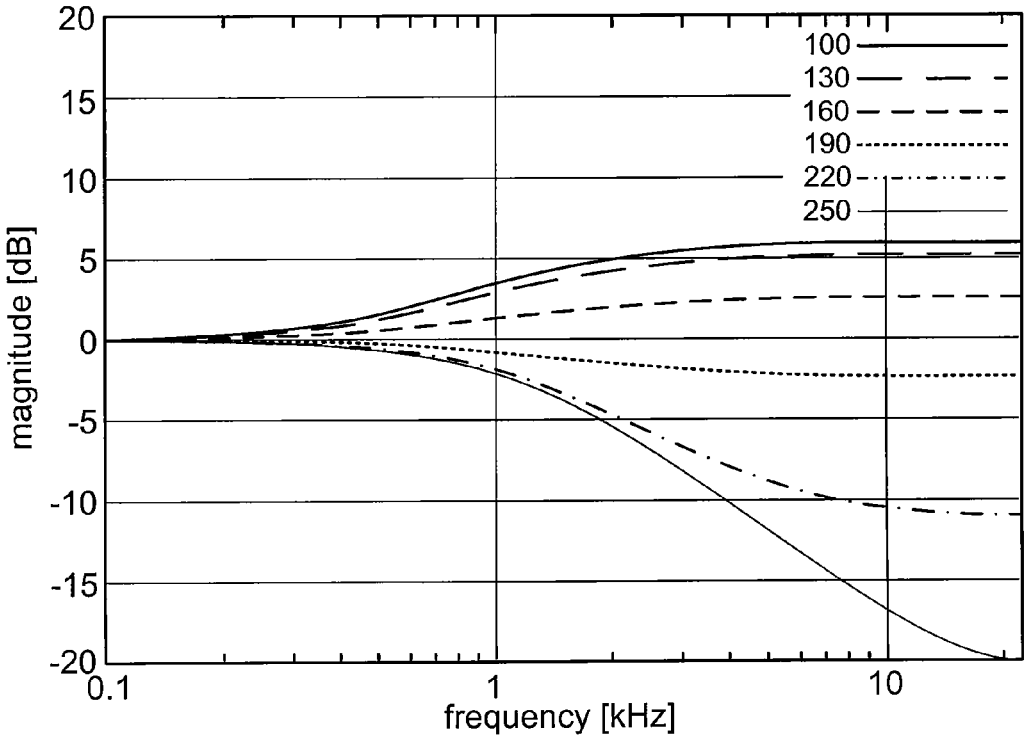
FIGS. 4*a* and 4*b* are graphs of group delay responses.
Figure 4B:
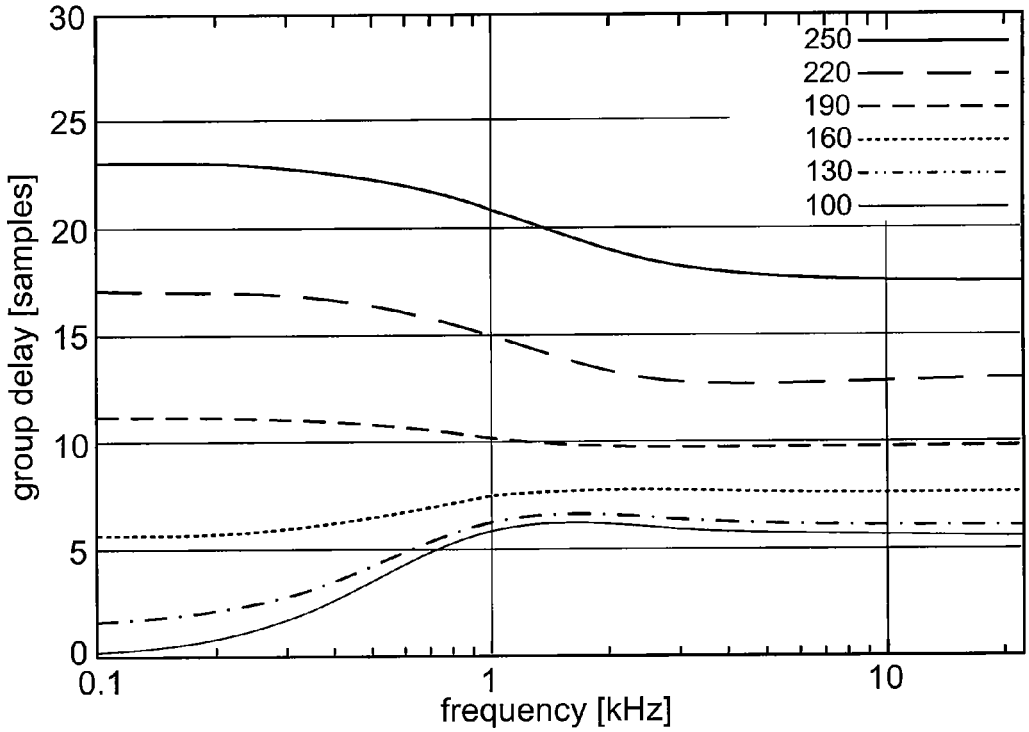

Actually, the group delay provided by the all-pass filter varies with frequency, but for these purposes such variability can be neglected. This increase of the group delay at DC is exactly what one observes for the real head. The overall magnitude and group delay responses of the block responsible for head shadowing and ITD are shown in FIGS. 4*a-b*. A useful technique for the realization of small group delay with all-pass filters is described in (6).

Besides head diffraction, we also have diffraction from the shoulder and torso. This can be synthesized in a single echo. An approximate expression of the time delay can be deduced by the measurements reported in [C. P. Brown, R. O. Duda, *IEEE Trans. Speech and Audio Processing*, Vol. 5. No. 5, September (1998)]

$$\tau_{sh}=1.2\frac{180^\circ-\theta}{180^\circ}\left(1-0.00004\left((\phi-80^\circ)\frac{180^\circ}{180^\circ-\theta}\right)^2\right)\ [\text{ms}] \tag{8}$$

where θ and ω are azimuth and elevation, respectively. The echo should also be attenuated as the source goes from a frontal to a lateral position. Of course (8) is only a rough approximation to real situation.

Finally, the pinna provides multiple reflections that can be obtained by means of a tapped delay line. In the frequency domain, these short echoes translate into notches whose position is elevation dependent and that are frequently considered as the main cue for the perception of elevation in monaural listening. A formula for the time delay of these echoes is given in [C. P. Brown, R. O. Duda, *IEEE Trans. Speech and Audio Processing*, Vol. 5. No. 5, September (1998)]

The delay of nth pinna event is modeled by expression:

$$\tau_{pn}(\theta,\phi)=A_n\cos(\theta/2)\sin[D_n(90-\phi)]+B_n,\ -90\le\theta\le90,\ -90\le\phi\le90 \tag{9}$$

where An is an amplitude, Bn is an offset, and Dn is a scaling factor. Limited experience, with three subjects, shows that only Dn has to be adapted to individual listeners.

TABLE 3

Coefficients values for pinna model

| n | $\rho_n$ | $A_n$ (samples at 44100 Hz ) | $B_n$ (samples at 44100 Hz ) | $D_n$ |
|---|---|---|---|---|
| 2 | 0.5 | 1 | 2 | 1 (0.85) |
| 3 | −1 | 5 | 4 | 0.5 (0.35) |
| 5 | 0.5 | 5 | 7 | 0.5 (0.35) |
| 5 | −0.25 | 5 | 11 | 0.5 (0.35) |
| 6 | 0.25 | 5 | 13 | 0.5 (0.35) |

Experimental measurements were made at θ=0; 15; 30; 45, and 60°, and the formula in (8) fits the measured data well. However, it fails near the pole at θ=90°, where there can be no elevation variation. Furthermore, (8) implies that the timing of the pinna events does not vary with azimuth in the frontal plane, where ω=90°.

The structural model of the pinna-head-torso system can be implemented with three functional blocks, repeated twice for the two ears. The only difference in the two halves of the system is in the azimuth parameter that is θ for the right ear and −θ for the left ear.

The Impulse response of a singular speaker in a fixed dimension room with the door closed and opened shows sound waves reflection changes measured at a single point in space. Clearly this has an impact on what one hears with such a minute surrounding changes. This is well known.

The loudspeaker in-room response is dominantly affected by the reflection from walls which are closest to the loudspeaker [W. G. Gardner: 3-D Audio Using Loudspeakers, Ms thesis, MIT (1997)]. So, if we analyze the response of the loudspeaker which is placed near the corner of the room, it is a good approximation to take into account only reflections from three walls that form the corner of the room. This approach is also correct from the psycho-acoustic standpoint, since early reflections (those in 20 ms time window) have a much higher perceptual significance than late reflections. To estimate the loudspeaker in-room response, we use the method of images on three perpendicular walls, but with a directional source characteristic included.

First, we approximate the loudspeaker box as a point directional source, that is, at some point (x,y,z↔r,ϕ, ν) in an unbounded space, the sound pressure is given by:

$$p(x, y, z, \omega) = p(r, \varphi, \vartheta, \omega) = W(j\omega)f(\varphi, \vartheta, j\omega)\frac{e^{-jkr}}{r} \tag{10}$$

where $W(_{j\omega})$ is the loudspeaker frequency response function and $f(\phi,\nu,j\omega)$ is the directivity function (loudspeaker directional characteristic). In this approximation we discard the effect of field perturbation due to finite loudspeaker box size, and the influence of wall reflections as reactive forces on the loudspeaker membrane.

Figure 5:
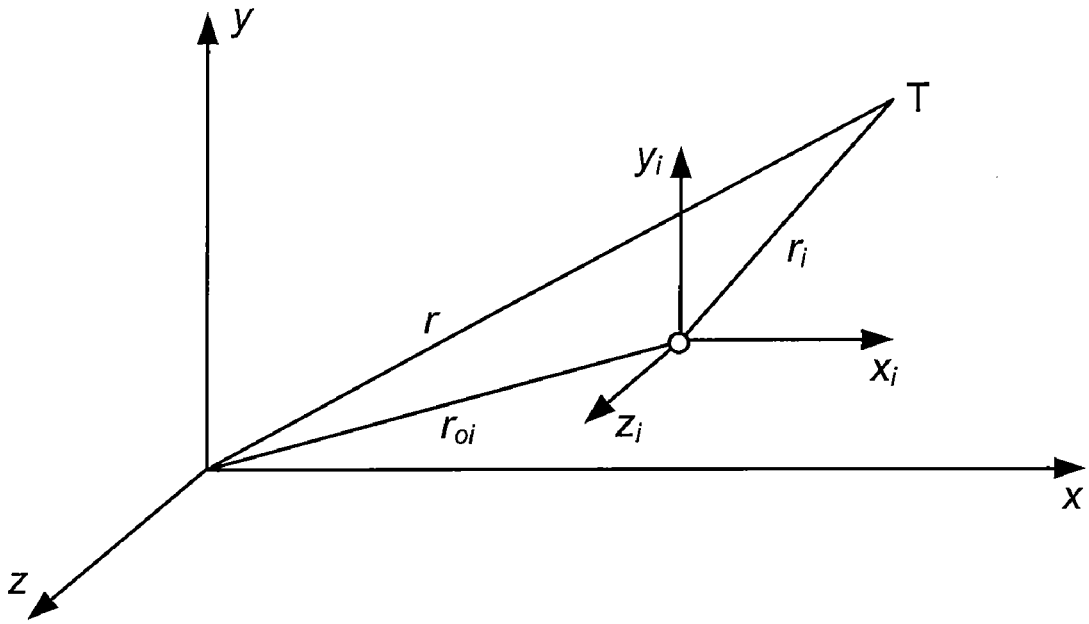
FIG. 5 is a diagram of a global and local coordinate system.

To adopt the method of images for directional sources, we assume that a room corner coincides with an origin of a global coordinate system (x,y,z). The loudspeaker position is at point $(x_{0i},y_{0i},z_{0i})$ that is also the origin of a local coordinate system $(x_i,y_i,z_i)$ (FIG. 5).

Local coordinates are parallel to global coordinates, but unit vectors can be of different directions, that is $$e_{xi}=q_ie_x,\ e_{yi}=u_ie_y,\ e_{zi}=w_ie_z,\ q_i,u_i,w_i=\pm 1,\ i=1,2,\ldots 8 \tag{13}$$

where $q_i$, $u_i$, and $w_i$ are direction factors with two possible values: 1 or −1. Now, we can express the position of a point in a local coordinate system as a product of direction factors and coordinates of a global coordinate system, that is:

$$T(x_i,y_i,z_i)=T(q_i(x-x_{0i}),u_i(y-y_{0i}),w_i(z-z_{0i})) \tag{13A}$$

This way, we can define eight different local coordinate systems. If in each of these coordinate systems we use the same expression for the acoustic pressure (Eq. 10), we obtain eight different directional characteristics in a global coordinate system.

Figure 6:
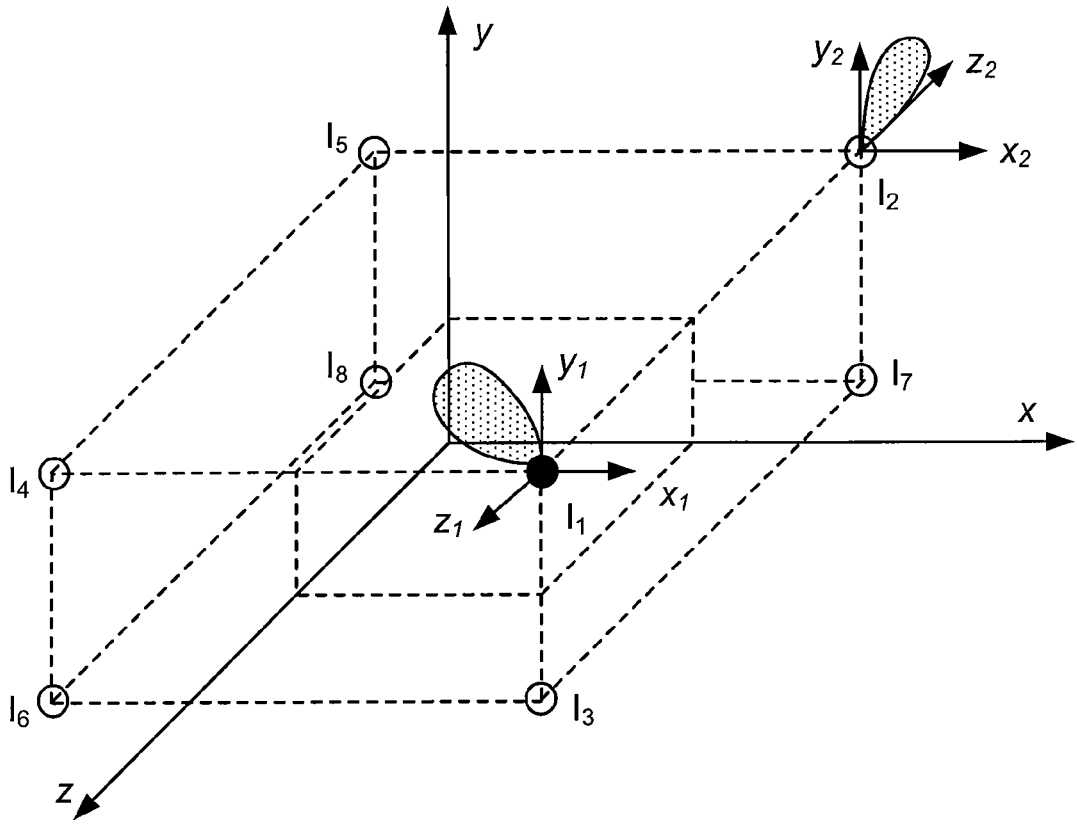
FIG. 6 is a diagram of a directional image source.
Figures 7A, 7B, 7C, 7D:
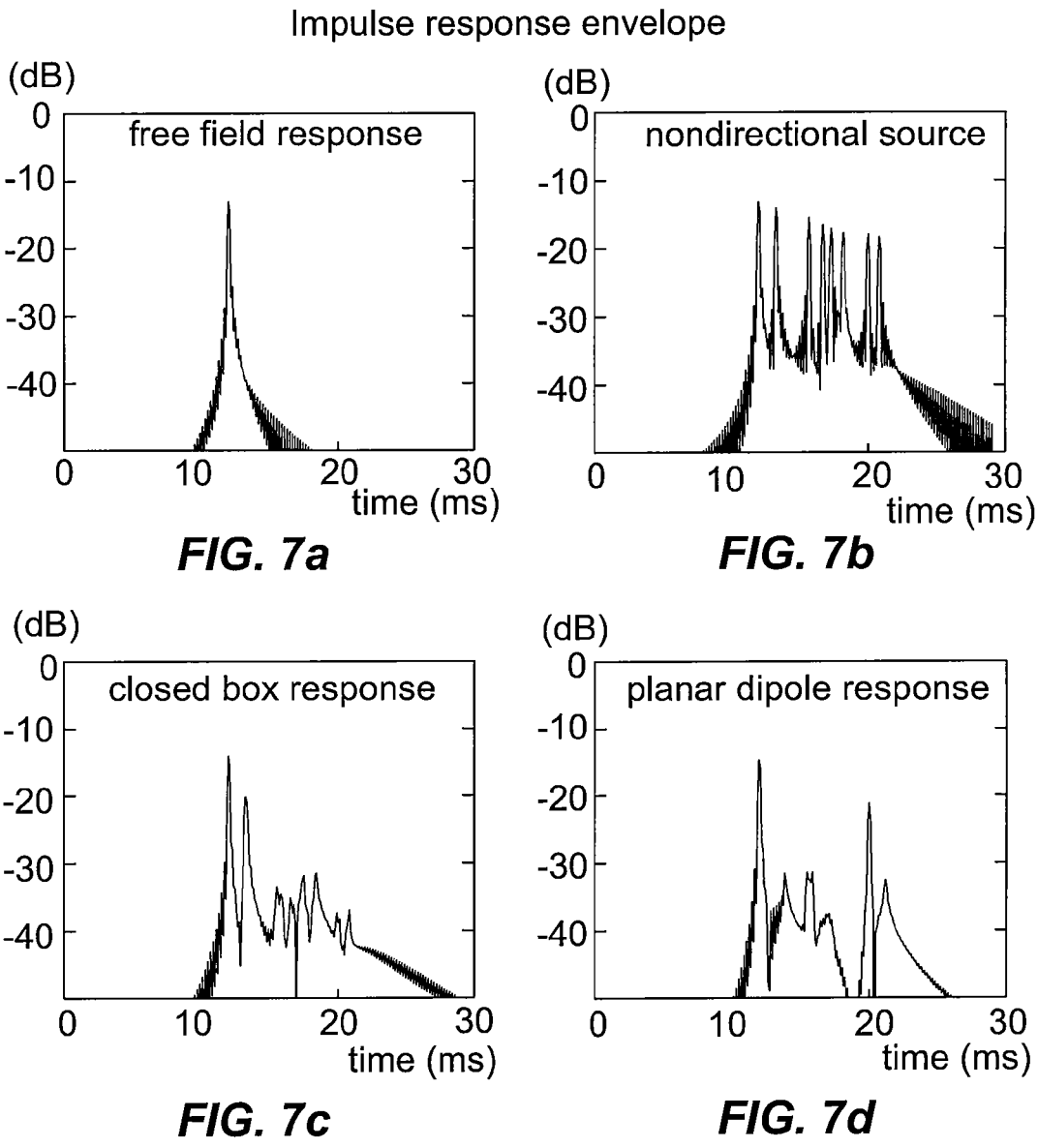
FIGS. 7*a*-7*d* are graphs of impulse responses.

It is important to note that changing the sign of one direction factor causes the direction change of one coordinate axis. This way, we obtain the directional characteristic that is an image of the source directional characteristic on a plane which is defined with two unchanged coordinates (FIG. 6).

FIGS. 7*a-d* show the impulse response envelope of a closed box, planar dipole and a nondirectional source which are placed in the corner of three rigid walls, compared with a free field response (x=4 m, y=1 m, z=4 m, $x_{01}$=1.2 m, $y_{01}$=1 m, $z_{01}$=0.8 m)

Images from Directional Sources

Now, we have elements to define the method of images for directional sources placed in the corner of three perpendicular walls.

Let the planes of these walls be defined with axes of a global coordinate system (x=0, y=0 and z=0). The source position is at point $I_1(x_{01},y_{01},z_{01})$ of a global coordinate system, and also at the origin of a local coordinate system ($q_1=u_1=w_1=1$). The source position can be modified depending on the speaker placement selected.

The total sound pressure in the region x,y,z>0 ($p_t$) can be calculated by summating the sound pressure of the source and seven image sources that are placed at points: $x_{0i}=q_ix_{01}$, $y_{0i=ui}y_{01}$, $z_{0i}=wiz_{01}$ (i=2, 3 . . . 8). For source and his images we use the same relation for the sound pressure in their local coordinate system $p(x_i,y_i,z_i)$. Then:

$$p_t(x, y, z) = \sum_{i=1}^{8} p(q_i(x - x_{0i}), u_i(y - y_{0i}), w_i(z - z_{0i})) \tag{15}$$

where the value of direction factors is given in Table 4.

TABLE 4

The value of direction factors

| i | 1 | 2 | 3 | 4 | 5 | 6 | 7 | 8 |
|---|---|---|---|---|---|---|---|---|
| $q_i$ | 1 | −1 | 1 | 1 | 1 | −1 | −1 | −1 |
| $u_i$ | 1 | 1 | −1 | 1 | −1 | −1 | 1 | −1 |
| $w_i$ | 1 | 1 | 1 | −1 | −1 | 1 | −1 | −1 |

The proof is quite simple: to satisfy boundary conditions we need to prove that the normal component of the sound pressure gradient on rigid walls is equal to zero. If we apply the gradient operator on Eq. (15), we obtain:

$$(\partial p_t/\partial x)_{for\ x=0} = 0 \Longrightarrow \sum_i q_i = 0 \tag{15A}$$

$$(\partial p_t/\partial y)_{for\ y=0} = 0 \Longrightarrow \sum_i u_i = 0$$

$$(\partial p_t/\partial z)_{for\ z=0} = 0 \Longrightarrow \sum_i w_i = 0$$

that is, the sum of all direction factors must be equal to zero. Since the defined value of each direction factor can be +1 or −1, we have eight possible combinations, shown in Table 1, to satisfy the boundary condition (15).

Eq. (15), giving the total sound pressure, can be further simplified to the form:

$$p_t(x, y, z) = \sum_{i=1}^{8} p((q_ix - x_{01}), (u_iy - y_{01}), (w_iz - z_{01})) \tag{16}$$

because the product of the direction factor and the appropriate image source coordinates is equal to the source coordinates ($x_{01}=q_ix_{0i}$, $y_{01}=u_iy_{0i}$ and $z_{01}=w_iz_{0i}$).

To calculate the total sound pressure using Eq. (16), we need the following data:

(1) the source position $(x_{01}, y_{01}, z_{01})$, (2) values of direction factors (Table 4), (3) an analytical expression for the sound pressure of the source in unbounded space.

If the loudspeaker directional characteristic is obtained by measuring the free-field response, then the analytical form of the directional characteristic has to be estimated from measured data by interpolation. We've assumed that the loudspeaker axis is in the z-axis direction. To estimate the response of a loudspeaker which is rotated for some angle α in the horizontal plane, we have to make the rotating transformation of a local coordinate system, that is, we substitute:

$$x \leftarrow x\cos\alpha - z\sin\alpha,\ z \leftarrow z\cos\alpha + x\sin\alpha,\ y \leftarrow y. \tag{17}$$

Similarly, if the loudspeaker rotates in the vertical plane for angle β, we substitute:

$$x \leftarrow x,\ y \leftarrow y\cos\beta + z\sin\beta,\ z \leftarrow -y\sin\beta + z\cos\beta. \tag{18}$$

In practical implementation we also use following formulas:

For listener at position x,y,z, distance of each image source is:

$$R_i=\sqrt{(x-q_i x_{01})^2+(y-u_i y_{01})^2+(z-w_i z_{01})^2} \quad (18A)$$

If we need horizontal and vertical angle (FH, FV) at which sound reach the listener head $$\varphi_V = \tan^{-1}\frac{y-u_i y_{01}}{z-w_i z_{01}} \quad (19)$$

$$\varphi_H = \tan^{-1}\frac{x-q_i x_{01}}{z-w_i z_{01}} \quad (20)$$

Delay from image sources relative to direct sound is:

$$D_i\ (\text{sec}) = \frac{R_i - R_0}{c} \quad (21)$$

Reverberation

Many studies have shown that for proper spatialization, a small amount of a reverberation is necessary. We have implemented an implementation of headphone externalization algorithm with reverberation time in the range $T_{60}$=0.2-0.4 sec.

The value of $T_{60}$ is also predictable from the requirement for good listening room. AES standard for multichannel listening advocates use of $T_{60}$ in the range:

$$T_{60}=0.25\sqrt[3]{V/V_0}\ \text{sec}$$

where V is room volume and $V_0$=100 $m^3$.

It is easy to implement a small reverberation time. In the Headphone externalization program we use classical Schroeder type of reverberator with two delay lines and two all-pass filters.

Some algorithms have fixed amount of reverberation. In listening tests we noticed that it is better that the user have the option to mix reverberation levels (dependant on music type).

In one embodiment we have applied the HRTF filter to early reflection, but not at reverberation signals, as it is assumed that reverberation is diffuse, as it comes from all directions.

Head-Movement Models

In one embodiment an automatic head movement simulation of a small angle is used to ascertain that a solid cue of position is reinforced. As referenced in Jens Blauert research, persistence of visual cues in the absence of an auditory event and vice versa can establish a perceptual relationship. Absence of visual confirmation of an audio event needs continual reinforcement such that drift of the source does not occur.

In one embodiment, the Headphone externalization system of the present invention treats each recording channel as sound from a virtual directional loudspeaker that is placed in front of reflecting walls in a room that has optimal "studio class" acoustics.

Figure 8:
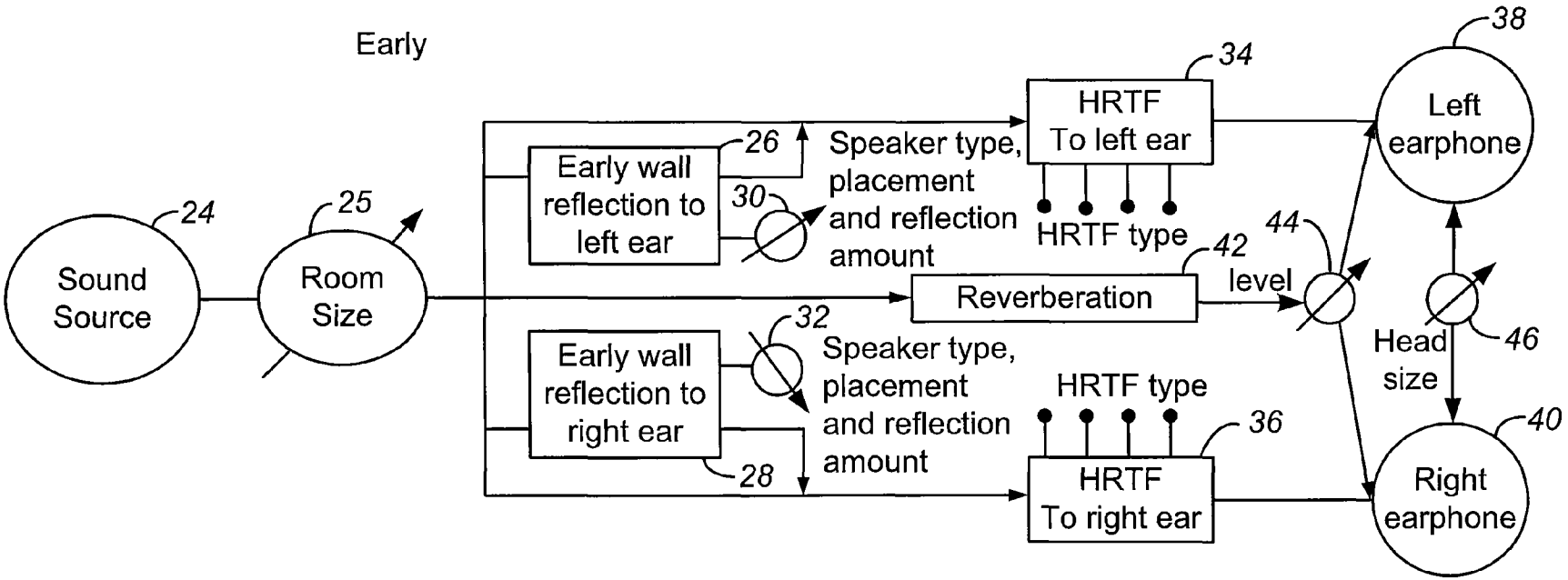
FIG. 8 is a block diagram of a headphone externalization system in accordance with an embodiment of the invention.

FIG. 8 shows components of the Headphone externalization processing system. For every virtual loudspeaker direct sound and early reflections from walls are filtered with user defined HRTF filters on both ears. Additionally, a "good room reverberation" is incoherently added to both ears.

FIG. 8 shows a sound source 24 which is processed in two channels (for stereo). The sound is adjusted for the room size by a user adjustment 25. A left ear channel is provided to a reflection module 26, which applies early wall reflection. This is adjusted in accordance with user-selected speaker type, placement and amount of reflection input 30. Similarly, for the right ear, a reflection module 28 and user selection input 32 are used. These are then applied to the HRTF filters 34 and 36, respectively. One of multiple (four shown in the example) different HRTF filter types is selected by the user. The sounds are applied to the left and right earphones 38 and 40, along with a reverberation effect as adjusted by a user adjustable level input 44. In one embodiment, the room size can optionally affect the reverberation as an input. Finally, the effects are modified by a user selected head size input 46. The head size input can be independent of the HRTF filters. If a model is used for the HRTF filters, or some other perceptual model, the head size can optionally be an input to such filter or model. For multi-channel implementations, the blocks of each channel can be duplicated, with 3 channels, 4, 5, etc. depending on the number of channel inputs. Each channel corresponds to a different speaker. For 3 channels, the third channel can be applied to one of the left or right earphone, or could be split between them. The same can occur for the 4th, 5th, etc. channel.

The user can choose from four (or another number of) types of HRTF IIR filters. The coefficients of filter are obtained by numerically fitting coefficients to measured HRTF of four typical listener groups. The user can also change the proposed head size.

In a case when processing speed is of prime importance, the user can switch to the reduced order filters that are analytically defined for a head that has spherical form.

The headphone externalization processing also allows the user to select an implementation of virtual loudspeakers. The user can choose the type of the loudspeaker directionality, the angle of the loudspeaker axis and the distance of the loudspeaker from the walls.

In one embodiment, rather than selecting from perceptual models or HRTF filters based on measured data, a customized model or filter for a particular user can be generated. This can be done based on measurements of that user's body, in particular the user's particular head, shoulder and pinna shapes and geometry. The user can measure these, or optical, acoustical or other measures could be used. Instead of using the measurements to select and existing model, a custom model could be generated. The measurements could be made optically, such as with a web cam. Or the measurements can be made acoustically, such as by putting microphones in the users ear and recording how sound appears at the ear from a known sound source. The measurements could be done in the user's home, so the headphones would simulate that user's surround sound speaker environment, or could be done in an optimized studio. The microphone can be used in conjunction with a designated group of sounds or music. The resulting data can be uploaded to a server, where it is analyzed and used to generate a custom model or HRTF filter for that user. It is then downloaded to the user's computer for use with the user's headphones.

The headphone externalization system in one embodiment implements multiple types of loudspeakers. In one embodiment, three types of directional loudspeakers are provided:

1) omnidirectional, 2) unidirectional (represent typical closed box loudspeaker)

3) bidirectional (represent typical planar open back loudspeaker)

In one embodiment, the implementation of wall reflections from directional loudspeakers uses an original method of "image for directional loudspeakers".

By using early wall reflections with delay 2-5 ms, the headphone externalization system enables all sound reflections that are common in good listening environments and sound studios.

Listening experience has shown that implementation of virtual loudspeakers also improves front-back localization.

In one embodiment, all adjusting procedures are independent of each other. They were chosen during intensive listening tests to be perceptually orthogonal. That gives users an easy adjusting procedure to setup the individualized system that best fits the user's desired listening experience.

Figure 9:
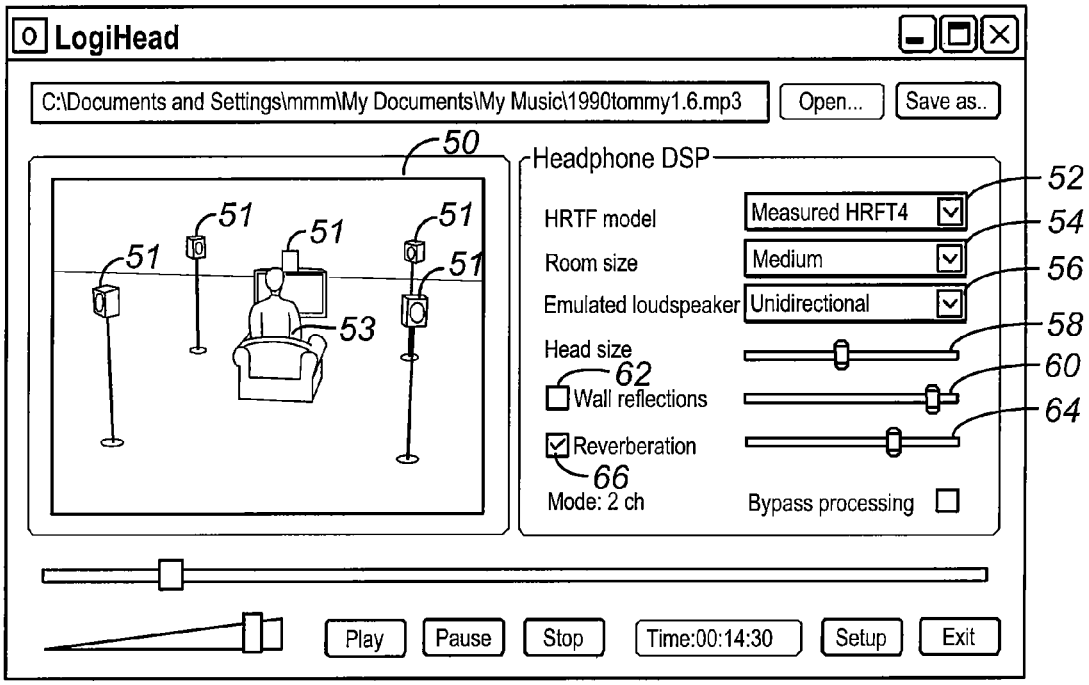
FIGS. 9-11 are screenshot diagrams of a user interface for adjusting the headphone externalization according to an embodiment of the invention.

FIG. 9 is a screenshot diagram of one embodiment of a user interface for adjusting the headphone externalization according to an embodiment of the invention. Other user interfaces could be used, as would be apparent to one of skill in the art. A window 50 shows the virtual speakers 51 and their positions around the user 53. The number of speakers can be determined from the number of channels in the audio to be played. The graphic of the room can change in accordance with the user selection of room size. In one embodiment, the user can drag and drop the speakers in other locations, or add or eliminate speakers. To the right of window 50 are various adjustments the user can select, including a HRTF model 52, room size 54, loudspeaker direction type 56, head size 58, reflections 60 and reverberation 62. In addition to the reflection and reverberation sliders, the user can simply check boxes 62 and 66 to turn reflections and reverberations on or off.

Figure 10:
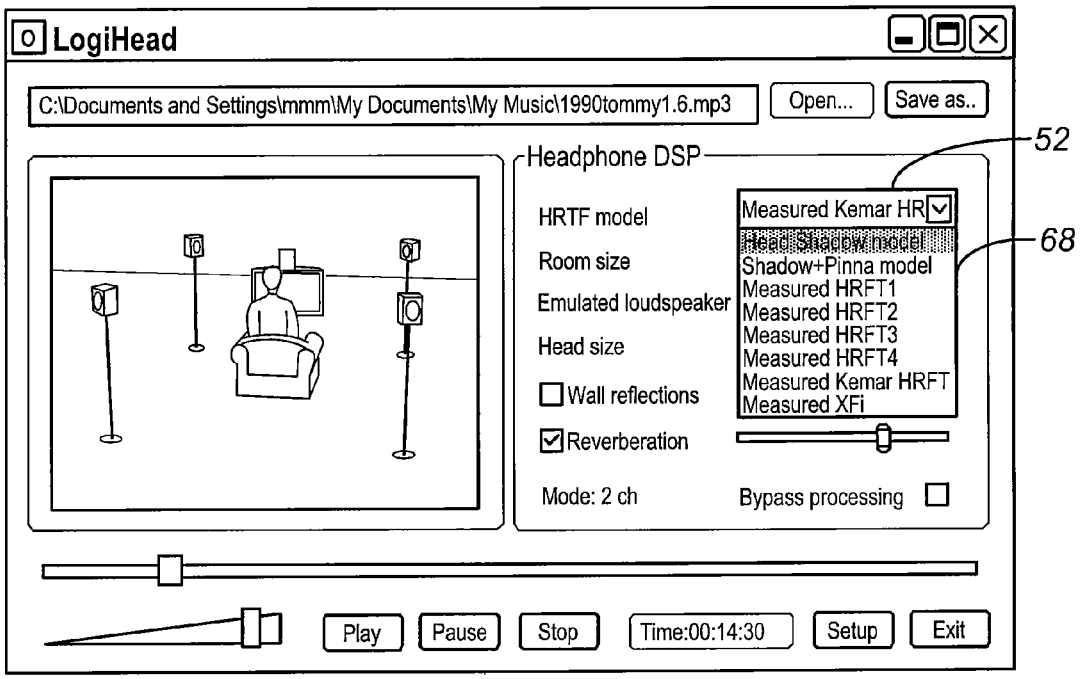

FIG. 10 illustrates a drop down list 68 from the HRTF model selection 52. As can be seen, the user can select on of four HRTF models based on actual data, or can select a number of models, or could download and add a desired HRTF filter. The user could measure aspects of the user's head, shoulders and pinna and input them for the software to match them up with the appropriate model. For example, using a tape measure, the user could measure head circumference, distance from forehead to chin, distance from ears to shoulders, ear length, shoulder width, etc. Alternately, an image of the user can be captured from a webcam, and image recognition software can determine the dimension, with the user indicating how far he/she is sitting from the webcam, or holding up a ruler or some other known dimension object. Alternately, the measurements could be done acoustically, or by any other method. The user can then be matched with the right model or data group, or a custom HRTF or other perceptual model could be designed for the user.

Similar drop down lists are provided for room size selection 54 (for example, the sizes are kept simple: small, medium or large), loudspeaker direction type selection 56 (e.g., omindirectional, unidirectional or bidirectional speakers.

Figure 11:
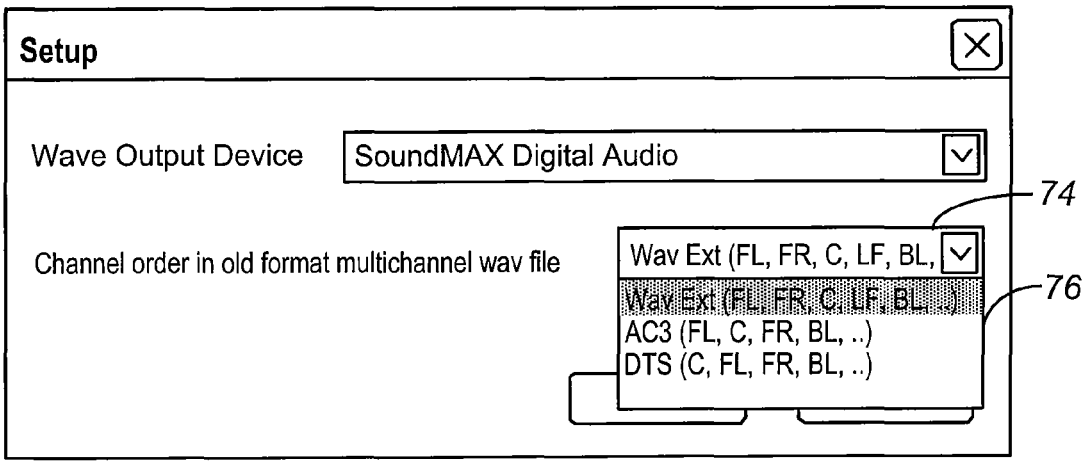

FIG. 11 illustrates a setup window with a channel order wave file selection box 74. A drop down list 76 provides different way file options Way Ext, AC3 and DTS. Each selection shows the different channels, each indicating a speaker location, such as FL (Front Left), FR (Front Right), C (Center) BL (Back Left), etc.

As will be understood by those of skill in the art, the present invention could be implemented in other specific forms without departing from the essential characteristics thereof. For example, the HRTFs could be grouped into 3 or 5 or any other number of sets, not just 4. Accordingly, the forgoing description is intended to be illustrative, not limiting, of the scope of the invention which is set forth in the following claims.

What is claimed is:

1. A method of providing a headphone set with sound signals such that a listener will perceive the sound as coming from a source outside of the listener's head, said method comprising the steps of:

accepting at least first and second input signals from a signal source;

processing each said first and second input signal so as to produce modified sound signals for presentation to the respective first and second inputs of a headphone set;

said processing step including the steps of:

passing each said signals through a perceptual model; and providing for listener selection of one of a limited set of perceptual models; and when a signal source is located closer to said listener than five times a head radius, increasing the interaural intensity difference at low frequencies below 1 KHz.

2. A method of providing a headphone set with sound signals such that a listener will perceive the sound as coming from a source outside of the listener's head, said method comprising the steps of:

measuring characteristics of said listener's body;

configuring a custom perceptual model based on said characteristics;

accepting an input signal from a signal source;

processing said input signal in each of first and second channels so as to produce modified sound signals for presentation to the respective first and second inputs of a headphone set;

said processing step including the steps of:

passing each said signals through said custom perceptual model; and when a signal source is located closer to said listener than five times a head radius, increasing the interaural intensity difference at low frequencies below 1 KHz.

3. A non-transitory computer readable media including computer readable code for use with a headphone set to provide sound signals such that a listener will perceive the sound as coming from a source outside of the listener's head, said computer readable code comprising:

measuring characteristics of said listener's body;

configuring a custom perceptual model based on said characteristics;

code for accepting at least first and second input signals from a signal source;

code for processing each said first and second input signal so as to produce modified sound signals for presentation to the respective first and second inputs of a headphone set;

said code for processing including:

code for passing each said signals through said custom perceptual model; and code for when a signal source is located closer to said listener than five times a head radius, increasing the interaural intensity difference at low frequencies below 1 KHz.

4. The method of claim 1 wherein said perceptual model is a Head Related Transfer Function (HRTF).

5. The method of claim 1 further comprising:

adjusting, by said listener, said perceptual model by selecting from among a group of perceptual models.

6. The method of claim 5 further comprising:

adjusting, by said listener, a head size used for said perceptual model.

7. The method of claim 5 further comprising:

adjusting, by said listener, at least one of a room size and loudspeaker type.

8. The method of claim 7 wherein said loudspeaker type is one of omnidirectional, unidirectional and bidirectional.

9. The method of claim 5 further comprising:

adjusting, by said listener, an amount of wall reflections and reverberation.

10. A non-transitory computer readable media including computer readable code for use with a headphone set to provide sound signals such that a listener will perceive the sound as coming from a source outside of the listener's head, said computer readable code comprising:

code for accepting at least first and second input signals from a signal source;

code for processing each said first and second input signal so as to produce modified sound signals for presentation to the respective first and second inputs of a headphone set;

said code for processing including:

code for passing each said signals through a perceptual model; and code for providing for listener selection of a loudspeaker type; and when a signal source is located closer to said listener than five times a head radius, increasing the interaural intensity difference at low frequencies below 1 KHz.

11. The method of claim 10 wherein said perceptual model is a Head Related Transfer Function (HRTF).

12. The method of claim 10 further comprising:

adjusting, by said listener, said perceptual model by selecting from among a group of perceptual models.

13. The method of claim 12 further comprising:

adjusting, by said listener, a head size used for said perceptual model.

14. The method of claim 12 further comprising:

adjusting, by said listener, at least one of a room size and loudspeaker type.

15. The method of claim 14 wherein said loudspeaker type is one of omnidirectional, unidirectional and bidirectional.

16. The method of claim 12 further comprising:

adjusting, by said listener, an amount of wall reflections and reverberation.

* * * * *